US010240495B2

(12) United States Patent
Radulescu

(10) Patent No.: US 10,240,495 B2
(45) **Date of Patent: *Mar. 26, 2019**

(54) LATCH PIN ASSEMBLY; ROCKER ARM ARRANGEMENT USING LATCH PIN ASSEMBLY; AND ASSEMBLING METHODS

(71) Applicant: EATON CORPORATION, Cleveland, OH (US)

(72) Inventor: Andrei Dan Radulescu, Marshall, MI (US)

(73) Assignee: Eaton Intelligent Power Limited, Dublin (IE)

( * ) Notice: Subject to any disclaimer, the term of this patent is extended or adjusted under 35 U.S.C. 154(b) by 151 days.

This patent is subject to a terminal disclaimer.

(21) Appl. No.: 15/345,136

(22) Filed: Nov. 7, 2016

(65) Prior Publication Data

US 2017/0051643 A1 Feb. 23, 2017

Related U.S. Application Data

(63) Continuation of application No. 14/356,201, filed as application No. PCT/US2012/063567 on Nov. 5, 2012, now Pat. No. 9,488,075.

(Continued)

(51) Int. Cl.
*F01L 1/18* (2006.01)
*F01L 13/00* (2006.01)

(Continued)

(52) U.S. Cl.
CPC ..... *F01L 13/0005* (2013.01); *F01L 1/04* (2013.01); *F01L 1/18* (2013.01); *F01L 1/46* (2013.01);

(Continued)

(58) Field of Classification Search
CPC ..... F01L 1/18; F01L 13/005; F01L 2105/00; F01L 1/04; F01L 13/0005; Y10T 29/49947

(Continued)

(56) References Cited

U.S. PATENT DOCUMENTS 5,544,626 A 8/1996 Diggs et al.
6,755,167 B2 1/2004 Krieg et al.

(Continued)

FOREIGN PATENT DOCUMENTS

DE 196 37 066 A1 3/1998
DE 10 2007 022847 A1 11/2008

(Continued)

OTHER PUBLICATIONS

International Search Report for corresponding International Patent Application PCT/US2012/063567 dated Jan. 3, 2013.

*Primary Examiner* — Ching Chang
(74) *Attorney, Agent, or Firm* — Merchant & Gould P.C.

(57) ABSTRACT

A rocker arm for engaging a cam in a valve actuation arrangement includes a latch pin assembly having includes a latch pin, retainer, and biasing mechanism. The latch pin has a pin body with a head and a tail at the second end; the body defining an open volume; the tail having an open mouth in communication with the open volume of the body; and the open volume having a non-circular cross-section. The retainer has a male engagement portion and an outer portion. The male engagement portion is within the open volume of the body through the open mouth. The male engagement portion has a non-circular cross section. The outer portion is non-removably secured to an outer arm of the rocker arm. The biasing mechanism is oriented in the open volume of the body and between and against the latch pin and the retainer.

30 Claims, 10 Drawing Sheets

Related U.S. Application Data

(60) Provisional application No. 61/556,282, filed on Nov. 6, 2011.

(51) Int. Cl.
*F01L 1/46* (2006.01)
*F01L 1/04* (2006.01)

(52) U.S. Cl.
CPC ..... *F01L 2103/00* (2013.01); *F01L 2105/00* (2013.01); *Y10T 29/49947* (2015.01); *Y10T 29/49968* (2015.01)

(58) Field of Classification Search
USPC ..... 123/90.39, 90.44
See application file for complete search history.

(56) References Cited

U.S. PATENT DOCUMENTS

| | | | | |
|---|---|---|---|---|
| 6,997,152 | B2 | 2/2006 | Harris | |
| 7,318,402 | B2 * | 1/2008 | Harman ..... | F01L 1/185 123/90.16 |
| 9,488,075 | B2 | 11/2016 | Radulescu | |
| 2007/0113809 | A1 | 5/2007 | Harman et al. | |
| 2009/0090317 | A1 | 4/2009 | Shin et al. | |
| 2011/0226208 | A1 | 9/2011 | Zurface et al. | |

FOREIGN PATENT DOCUMENTS

| | | |
|---|---|---|
| JP | 60020741 | 2/1985 |
| JP | 05075929 | 10/1993 |
| JP | 2009509081 | 3/2009 |
| WO | WO 2007/035673 A2 | 3/2007 |

* cited by examiner

LATCH PIN ASSEMBLY; ROCKER ARM ARRANGEMENT USING LATCH PIN ASSEMBLY; AND ASSEMBLING METHODS

CROSS REFERENCE TO RELATED APPLICATIONS

This application is a continuation application of U.S. Ser. No. 14/356,201, filed May 5, 2015, which is a National Stage Application of PCT International Patent Application No. PCT/US2012/063567, filed 5 Nov. 2012, which claims the benefit of U.S. patent application Ser. No. 61/556,282 filed on 6 Nov. 2011, and which applications are incorporated herein by reference. To the extent appropriate, a claim of priority is made to each of the above disclosed applications.

TECHNICAL FIELD

This disclosure is directed to rocker arms for internal combustion engines. In particular, this disclosure is directed to a latch pin assembly usable in selectively deactivating and activating a rocker arm, methods of assembly, and methods of use.

BACKGROUND

Many internal combustion engines utilize rocker arms to transfer rotational motion of cams to linear motion appropriate for valve actuation in an engine. Rocker arms can be selectively deactivated by including a mechanism to allow for selective deactivation of the rocker arm if there is a desire to shut off one of the engine valves, e.g., if less power is needed and fuel economy is desired. In many cases, a latch pin is used for the selected activation and deactivation of the rocker arm. When a flat latch pin surface is used, the latch pin needs to be oriented rotationally to allow proper engagement with the mating flat surface. The orientation of the latching pin can be challenging due to the precision needed to orient the latching pin with considerations for the costs for manufacturing. Improvements are desireable to address this problem.

SUMMARY

In one aspect, a latch pin assembly for a rocker arm in a valve actuation arrangement is provided. The latch pin assembly includes a latch pin having a pin body with first and second opposite ends, an arm engaging head at the first end, and a retainer engaging tail at the second end. The body defines an open volume. The tail has an open mouth in communication with the open volume of the body. The open volume has a non-circular cross section. A retainer having a male engagement portion is provided. The male engagement portion is received within the open volume of the body through the open mouth. The male engagement portion has a non-circular cross section. A biasing mechanism is oriented in the open volume of the body and is between and against the latch pin and the retainer.

In another aspect, a rocker arm for engaging a cam in a valve actuation arrangement is provided. The rocker arm includes an outer arm, an inner arm, a pivot axle securing the outer arm and the inner arm, a cam contacting member configured to transfer motion from a cam to the rocker arm, and a latch pin assembly. The latch pin assembly is held by the outer arm and is movable between an engaged position and disengaged portion. The engaged position secures the outer arm and inner arm together causing the outer arm and inner arm to move together in response to the cam. The disengaged position permits the inner arm to pivot relative to the outer arm about the pivot axle in response to the cam. The latch pin assembly includes a latch pin having a pin body with first and second opposite ends; a head at the first end selectively engaging the inner arm; a tail at the second end; the body defining an open volume; the tail having an open mouth in communication with the open volume of the body; and the open volume having a non-circular cross-section. The latch pin assembly also includes a retainer having a male engagement portion and an outer portion. The male engagement portion is within the open volume of the body through the open mouth. The male engagement portion has a non-circular cross section. The outer portion is non-removably secured to the outer arm. The latch pin assembly also includes a biasing mechanism oriented in the open volume of the body and between and against the latch pin and the retainer.

In another aspect, a method of assembling a latch pin assembly to a rocker arm is provided. The method includes proving a rocker arm having an outer arm and an inner arm and a pivot axle securing the outer arm and the inner arm. The outer arm has a bore. The method includes inserting a latching pin having a pin body with a head and tail into the bore until the head is in engagement with the inner arm. The pin body has an open volume with a non-circular cross section. The method includes inserting a biasing mechanism in the open volume and inserting a retainer into the open volume of the pin body. The retainer has a male engagement portion with a non-circular cross section. Next, the retainer is non-removably secured to the outer arm.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements, or that multiple elements may be designed as single element. An element shown as an internal feature may be implemented as an external feature and vice versa. In the accompanying drawings and description that follow, like parts are indicated throughout the drawings and description with the same reference numerals, respectively. The figures may not be drawn to scale, and the proportions of certain parts have been exaggerated for convenience of this illustration.

DETAILED DESCRIPTION

A. Overview, FIGS. 1-4

Figure 1:
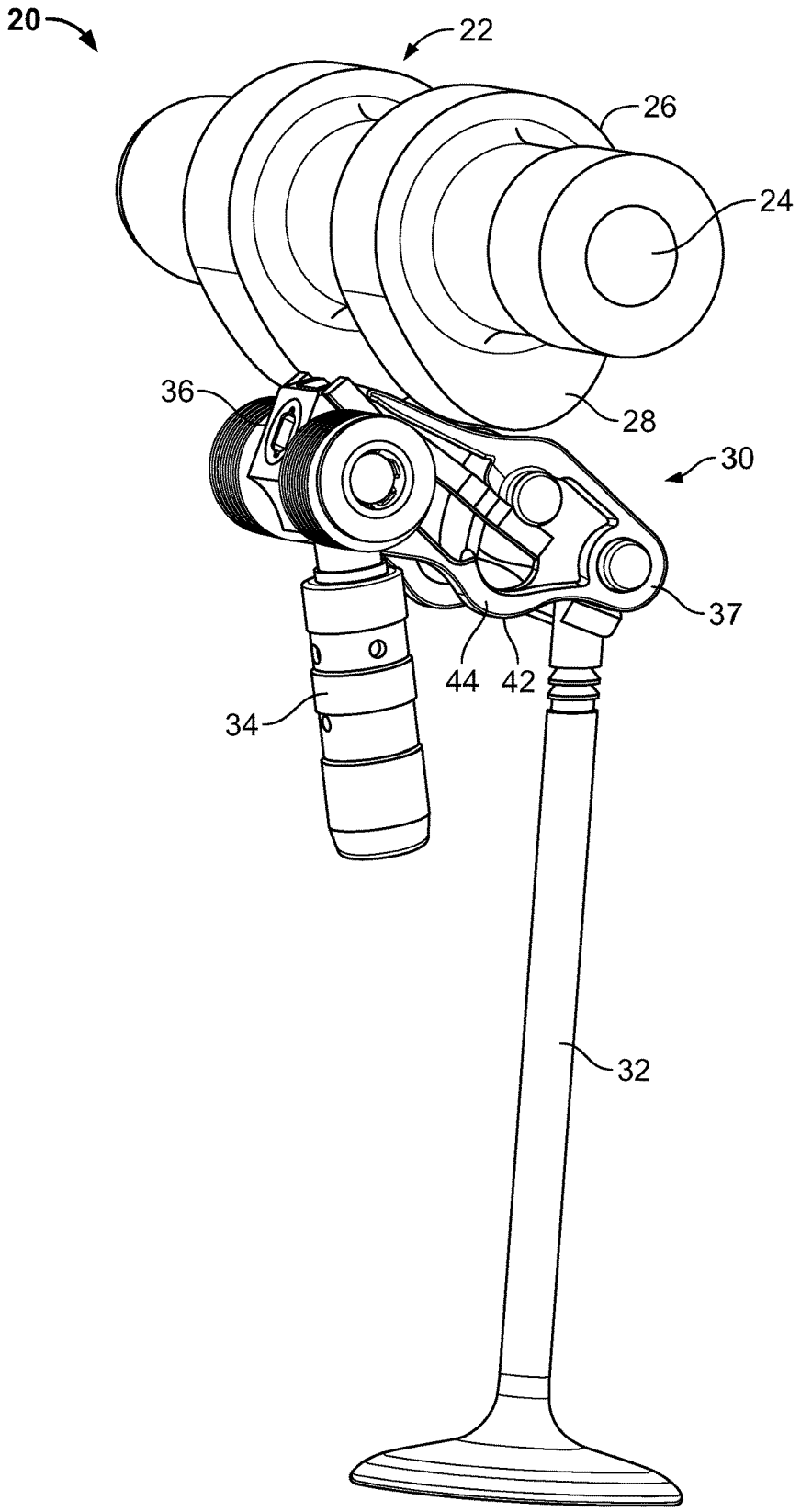
FIG. 1 is a perspective view of a valve actuation arrangement including a rocker arm in an activated position, a cam, a valve stem, and a lash adjuster, constructed in accordance with principles of this disclosure.
Figure 2:
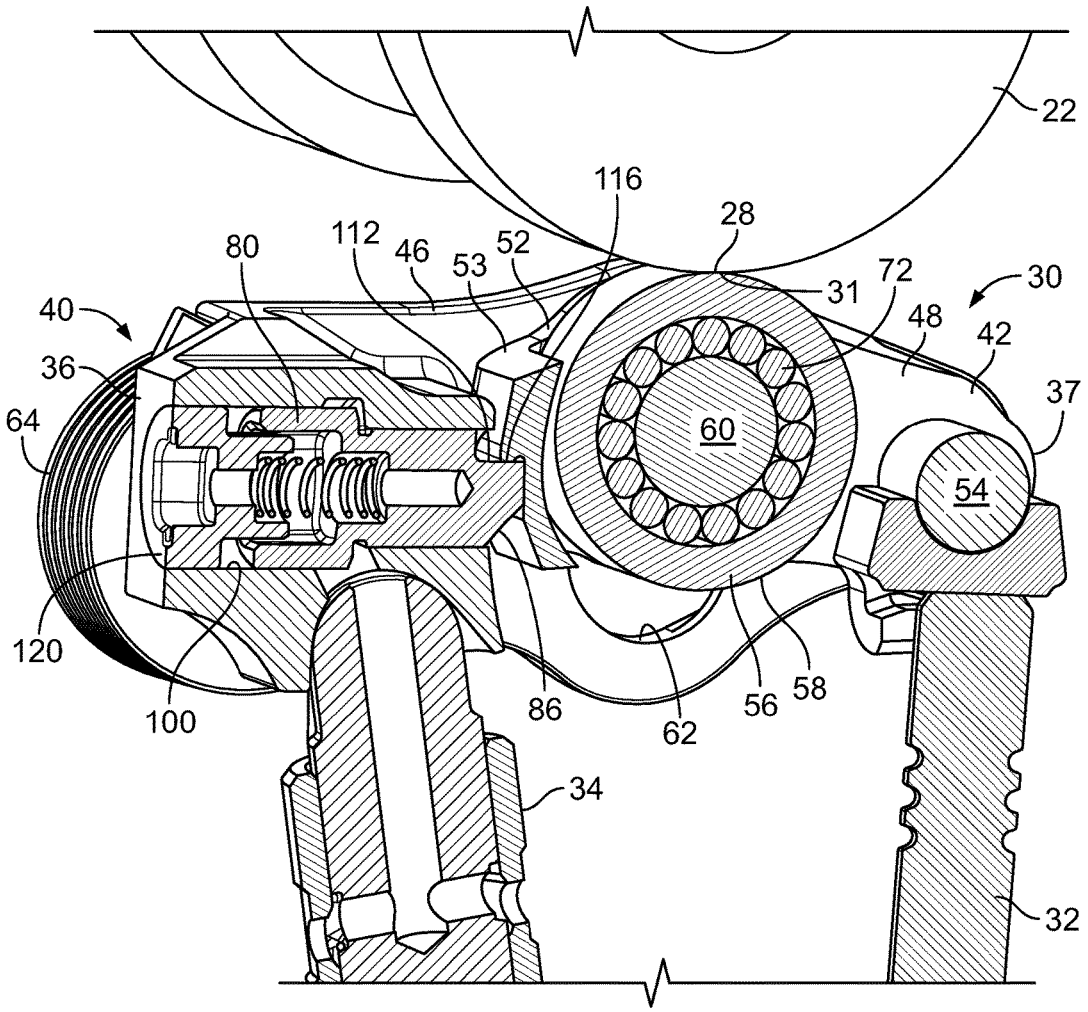
FIG. 2 is a cross-sectional view of a portion of the arrangement of FIG. 1, and showing a latch pin assembly in the engaged position activating the rocker arm, designed in accordance with principles of this disclosure.
Figure 3:
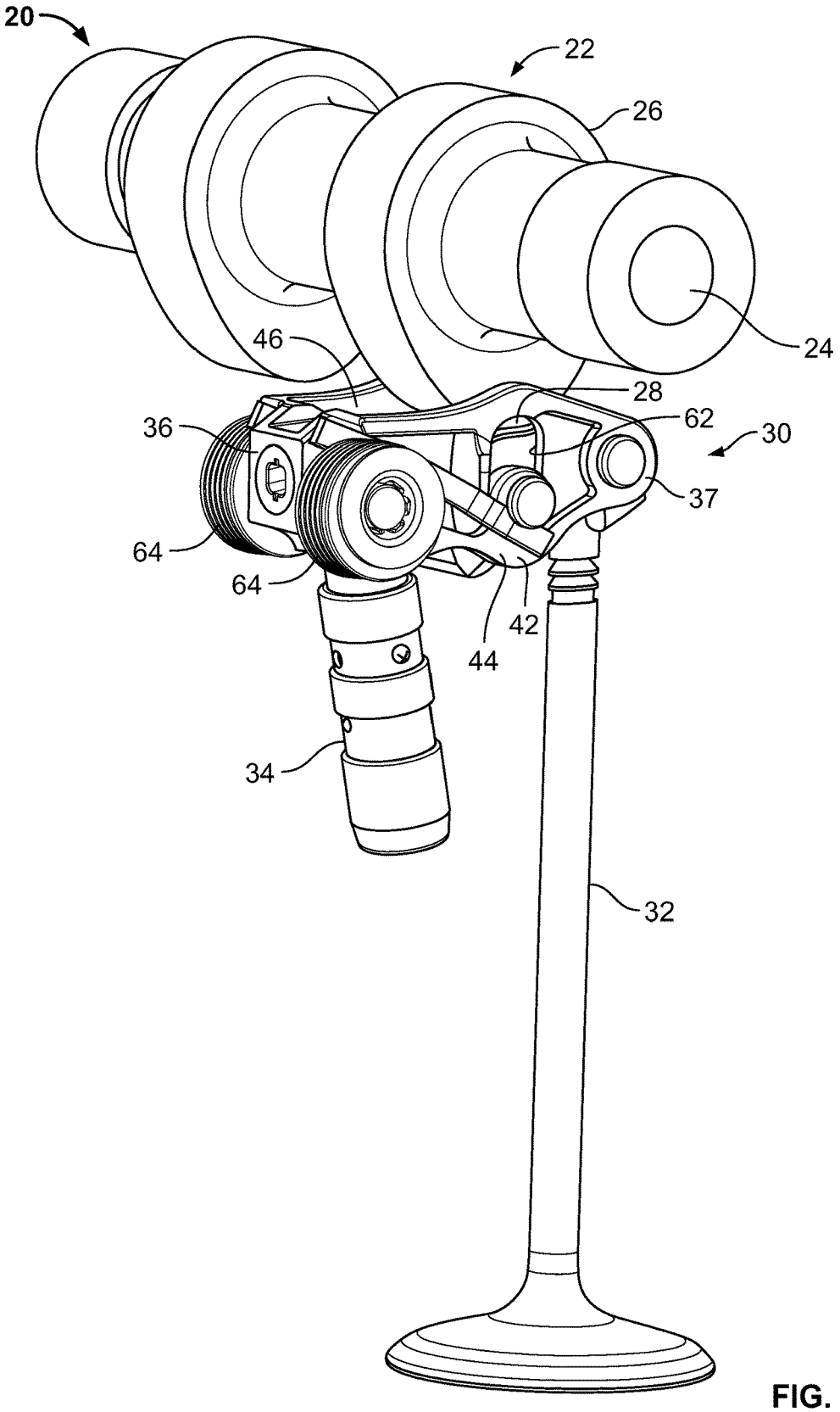
FIG. 3 is a perspective view of the valve actuation arrangement of FIG. 1 but now showing the rocker arm in a deactivated position.
Figure 4:
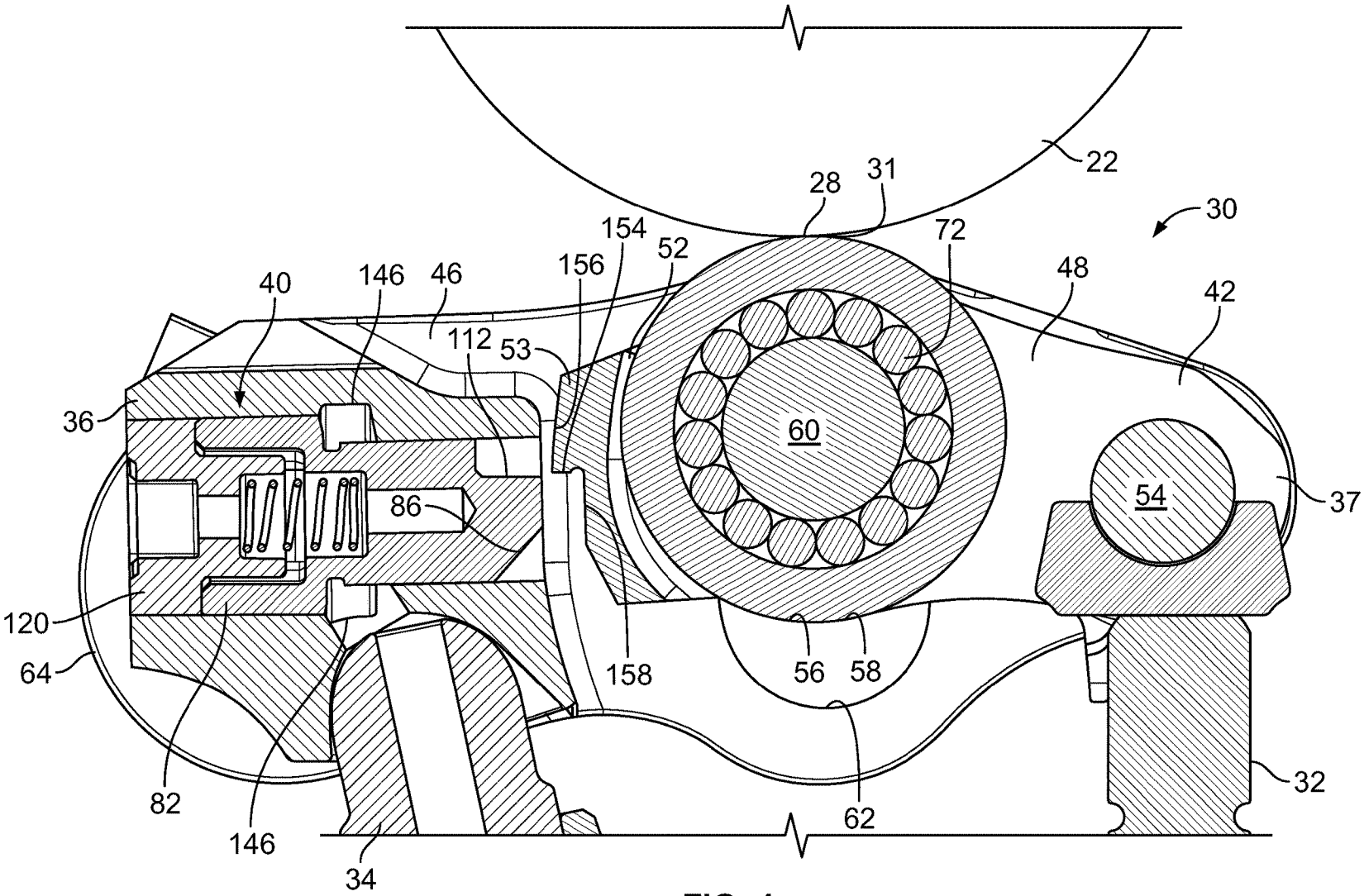
FIG. 4 is a cross-sectional view of a portion of the arrangement of FIG. 3, and showing a latch pin assembly in the disengaged position to deactivate the rocker arm, designed in accordance with principles of this disclosure.

FIGS. 1 and 3 show a valve actuation arrangement 20 including a rocker arm 30, a cam 22, a valve stem 32, and a lash adjuster 34. FIGS. 1 and 2 show the rocker arm 30 in an "activated position," in which movement of the cam 22 results in movement of the valve stem 32. FIGS. 3 and 4 show the rocker arm 30 in a "deactivated position," in which movement of the cam 22 does not translate into movement of the valve stem 32.

In FIGS. 1 and 3, the valve actuation arrangement 20 includes cam 22 having a shaft 24, and a lift lobe 26. The lift lobe 26 includes a lifting portion 28.

The cam 22 makes contact with the rocker arm 30 at a cam contacting surface 31 (FIGS. 2 and 4) on the rocker arm 30. As will be explained further below, the rocker arm 30 includes a latch pin assembly 40 (FIGS. 2 and 4), movable between an engaged and a disengaged position. When the latch pin assembly 40 is in the engaged position (FIGS. 1 and 2), the rocker arm 30 is activated and will periodically push the valve stem 32, shown attached to the rocker arm 30, downward, which will open the corresponding valve (not shown). That is, the cam 22 rotates about shaft 24, and lifting portion 28 of the lift lobe 26 pushes on the rocker arm 30, which causes the rocker arm 30 to push the valve stem 32 downward.

When the latch pin assembly 40 is in the disengaged position (FIGS. 3 and 4), the rocker arm 30 is deactivated and will not transmit force to the valve stem 32. The lash adjuster 34 is illustrated engaging the rocker arm 30 at a first end 36, which is opposite a second end 37 of the rocker arm 30. The lash adjuster 34 applies upward pressure to the rocker arm 30 while mitigating against valve lash. In FIGS. 3 and 4, the latch pin assembly 40 is disengaged. When the latch pin assembly 40 is disengaged, contact between the lifting portion 28 of the cam 22 and the rocker arm 30 does not result in the rocker arm 30 pushing the valve stem 32 downward. Rather, there is "lost motion", which is explained further below.

B. Example Rocker Arm 30, FIGS. 5-7

The rocker arm 30 includes an outer arm 42. In this example, the outer arm 42 has a first outer side arm 44 and a second outer side arm 46. In this example, the first outer side arm 44 and second outer side arm 46 are spaced from each other.

Figure 5:
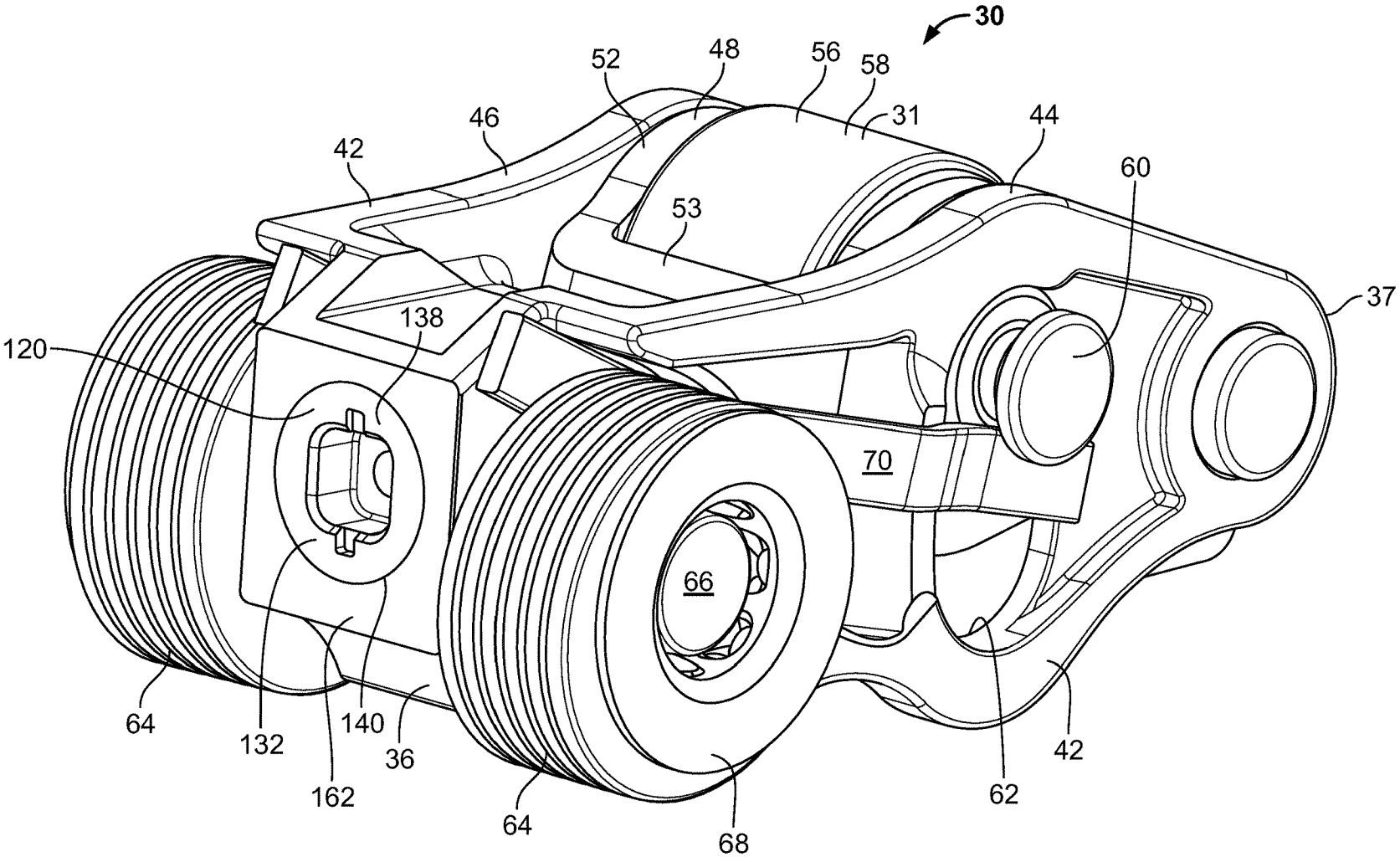
FIG. 5 is a perspective view of the rocker arm shown in FIGS. 1-4.

The rocker arm 30 further includes an inner arm 48. In this example, the inner arm 48 includes a first inner side arm 50 and a second inner side arm 52. As can be seen in FIG. 5, the first and second outer side arms 44, 46 are spaced apart from each other and contain between them the inner arm 48 including the first and second inner side arms 50, 52. A connection member 53, which is part of the inner arm 48 in this example, joins the first and second inner side arms 50, 52.

Figure 6:
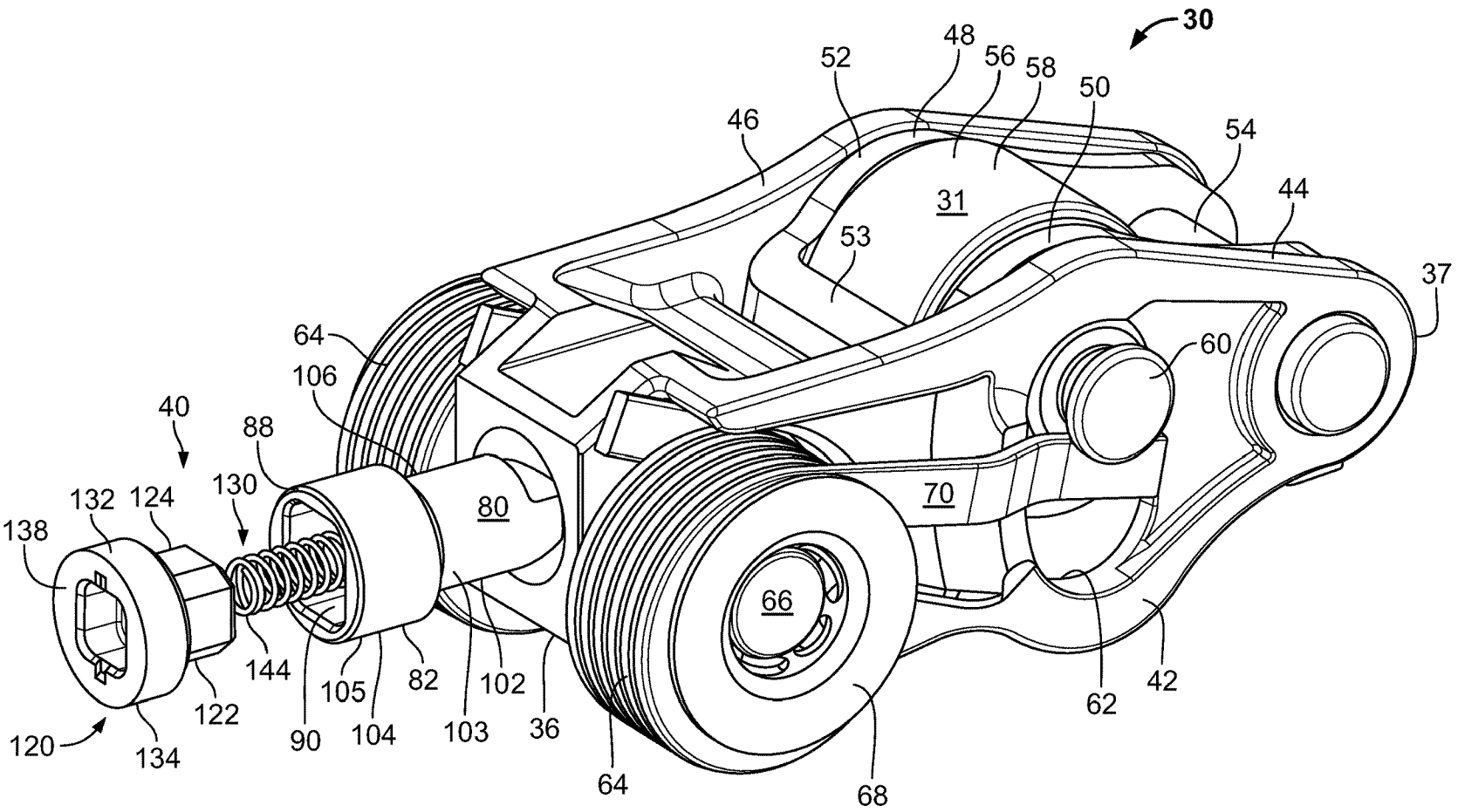
FIG. 6 is a perspective view of the rocker arm of FIG. 5 and showing the latch pin assembly exploded from the rest of the rocker arm.
Figure 7:
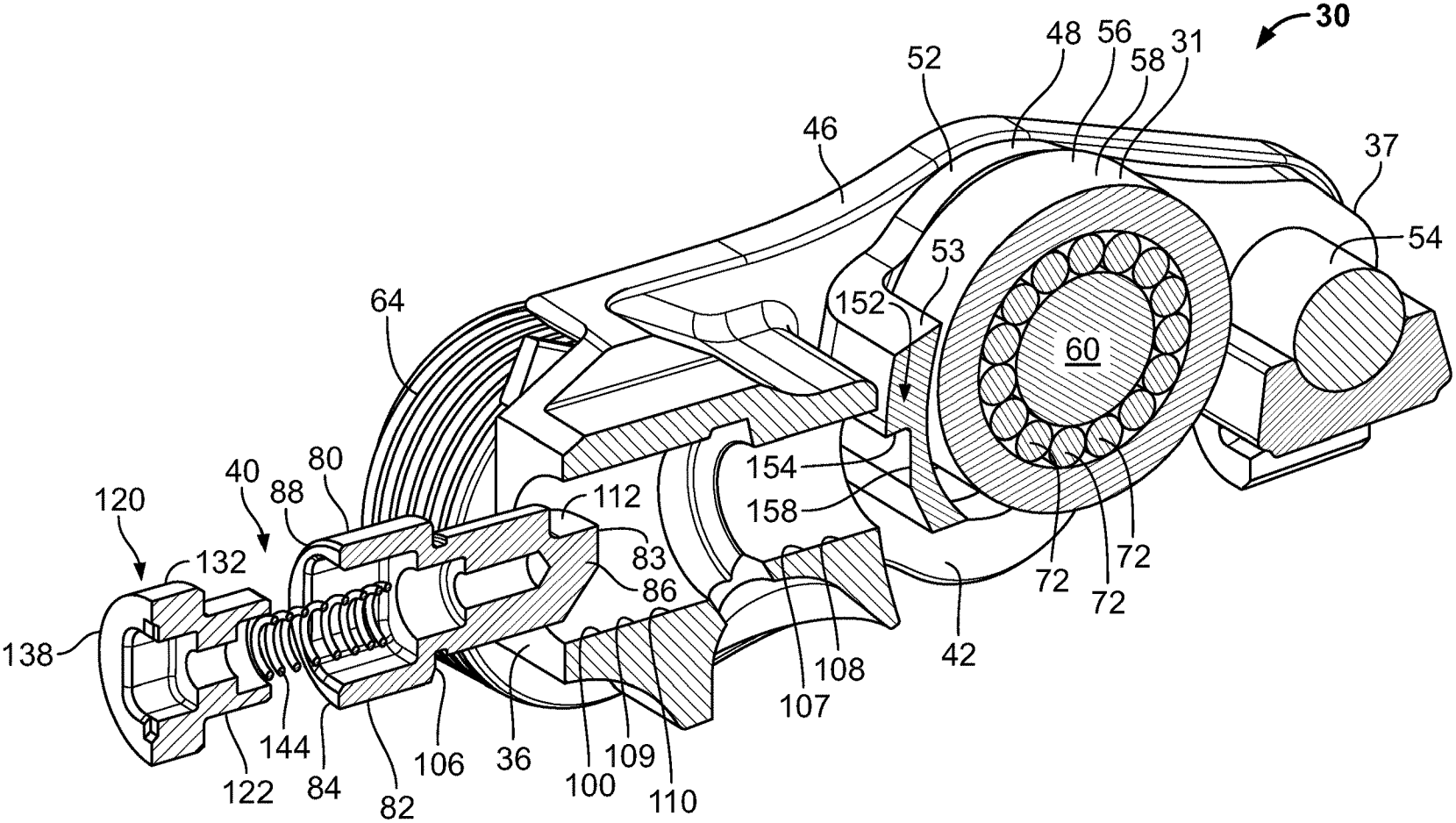
FIG. 7 is a perspective, cross-sectional view of the rocker arm and latch pin assembly of FIGS. 5 and 6.

The inner arm 48 and the outer arm 42 are both mounted to a pivot axle 54 (FIGS. 6 and 7). The pivot axle 54 is located adjacent to the second end 37 of the rocker arm 30. The pivot axle 54 secures the inner arm 48 to the outer arm 42 while also allowing a rotational degree of freedom pivoting about the pivot axle 54 when the rocker arm 30 is in a deactivated state (FIGS. 3 and 4). In other aspects of the present teachings, the pivot axle 54 can be integral to the outer arm 42 or the inner arm 48.

The rocker arm 30 has a bearing 56 including a roller 58 that is mounted between the first inner side arm 50 and the second inner side arm 52 on a bearing axle 60 that, during normal operation of the rocker arm 30, serves to transfer energy from the cam 22 to the rocker arm 30. Mounting the roller 58 on the bearing axle 60 allows the bearing 56 to rotate about the axle 60, which serves to reduce the friction generated by the contact of the rotating cam 22 with the roller 58. As can be appreciated from the examples shown, the roller 58 includes the cam contacting surface 31.

In the example shown, the bearing axle 60 is mounted to the inner arm 48 and extends through the bearing axle slots 62 of the outer arm 42. Other configurations are possible. When the rocker arm 30 is in a deactivated state (FIGS. 3 and 4), the inner arm 48 pivots downwardly relative to the outer arm 42 when the lifting portion 28 of the cam 22 comes into contact with the roller 58 of bearing 56, thereby pressing it downward. The axle slots 62 in the outer arm 42 allow for the downward movement of the bearing axle 60, and therefore of the inner arm 48 and bearing 56. As the cam 22 continues to rotate, the lifting portion 28 of the cam 22 rotates away from the roller 58 of the bearing 56, allowing the bearing 56 to move upwardly as the bearing axle 60 is biased upwardly by bearing axle springs 64.

In the examples shown, the bearing axle springs 64 are torsion springs secured to mounts 66 located on the outer arm 42 by spring retainers 68. The bearing axle springs 64 are secured adjacent to the first end 36 of the rocker arm 30 and have spring arms 70 that come into contact with the bearing axle 60. As the bearing axle 60 and the spring arm 70 moves downwardly, the bearing axle 60 slides along the spring arm 70. The configuration of the rocker arm 30 having the axle springs 64 secured adjacent to the first end 36 of the rocker arm 30, and the pivot axle 54 located adjacent to the second end 37 of the rocker arm 30, with the bearing axle 60 between the pivot axle 54 and the axle springs 64, lessens the mass near the second end 37 of the rocker arm 30.

As can be seen in FIGS. 1-4, the valve stem 32 is in contact with the rocker arm 30 adjacent the second end 37, and thus the reduced mass at the second end 37 of the rocker arm 30 reduces the mass of the overall valve train (not shown), thereby reducing the force necessary to change the velocity of the valve train. It should be noted that other spring configurations may be used to bias the bearing axle 60, such as a continuous spring.

FIG. 7 illustrates a partially exploded, cross-sectional view of the rocker arm 30. As shown in FIG. 7, the bearing 56 is a needle roller-type bearing that includes the roller 58 in combination with needles 72, which can be mounted on the bearing axle 60. The bearing 56 serves to transfer the rotational motion of the cam 22 to the rocker arm 30 at cam contacting surface 31 that in turn transfers motion to the valve stem 32 (FIGS. 1-4). As previously mentioned, the bearing axle 60 is illustrated as being received within the axle slots 62 of the outer arm 42. This allows for "lost motion" movement of the bearing axle 60 and the inner arm 48 when the rocker arm 30 is in a deactivated state (FIGS. 3 and 4). "Lost motion" movement can be considered movement of the rocker arm 30 that does not transmit the rotating motion of the cam 22 to the valve stem 32. In the illustrated examples, lost motion is exhibited by the pivotal motion of the inner arm 48 relative to the outer arm 42 about the pivot axle 54.

The mechanism for selectively deactivating the rocker arm 30 is the latch pin assembly 40. In the example aspects of the present teachings, the latch pin assembly 40 is adjacent to the first end 36 of the rocker arm 30. By way of this example, the latch pin assembly 40 is configured to be mounted inside of the outer arm 42. When the latch pin assembly 40 is in an engaged position (FIGS. 1 and 2) the inner arm 48 is removably secured to the inner arm 42, thereby preventing the inner arm 48 from moving with respect to the outer arm 42. When the latch pin assembly 40 is in the engaged position, the rocker arm 30 is in an activated state, which will allow for the transfer of force from the cam 22 to the valve stem 32. When the latch pin assembly 40 is disengaged, the inner arm 48 is allowed to pivot about the pivot axle 54 relative to the outer arm 42. When disengaged, the rocker arm 30 is deactivated, and motion from the cam 22 translates into lost motion, which is the pivoting of the inner arm 48 about the pivot axle 54 relative to the outer arm 42, with the bearing axle 60 moving linearly within the axle slots 62 of the outer arm 42.

C. Example Latch Pin Assembly 40, FIGS. 6-10

In reference now to FIGS. 6-10, one example of the latch pin assembly 40 is further described. As mentioned in the background, one problem encountered is when the rocker arm 30 is in the deactivated state, the latch pin assembly 40 is disengaged and when disengaged, the latch pin assemblies of the prior art could rotate or move relative to the rest of the rocker arm 30. This rotation of the latch pin assemblies of the prior art relative to the rest of the rocker arm 30 can contribute to a problem when it is time to re-engage the latch pin and activate the rocker arm 30. The latch pin assembly 40 as described and illustrated herein can be shown to address that problem without adding undo cost to the manufacturing and assembly process.

Figure 8:
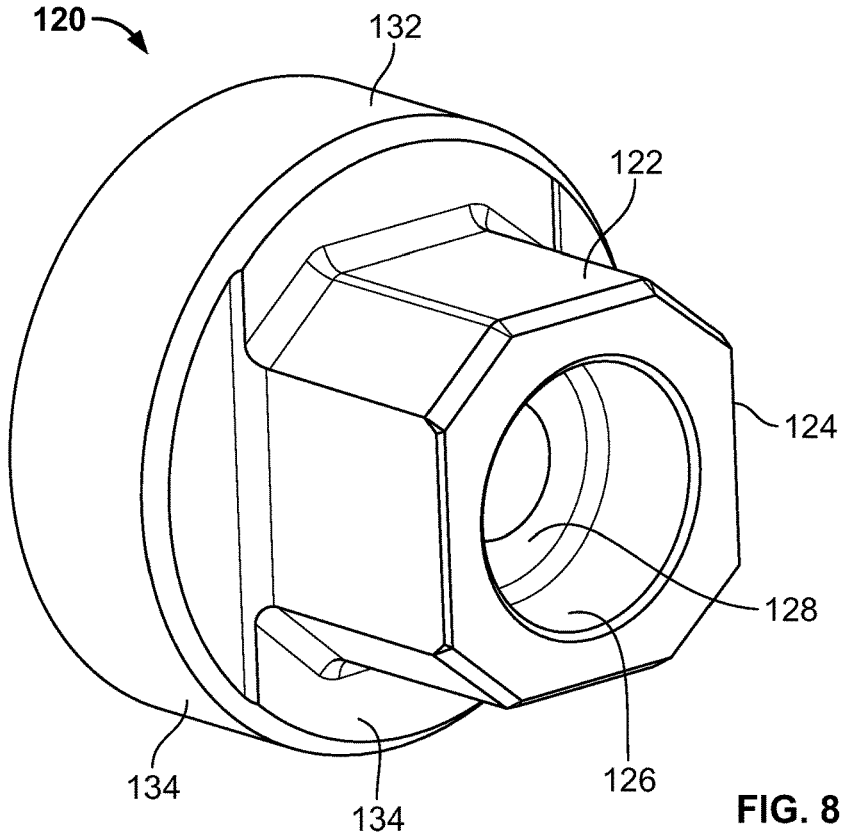
FIG. 8 is a perspective view of a retainer used in the latch pin assembly, constructed in accordance with principles of this disclosure.
Figure 9:
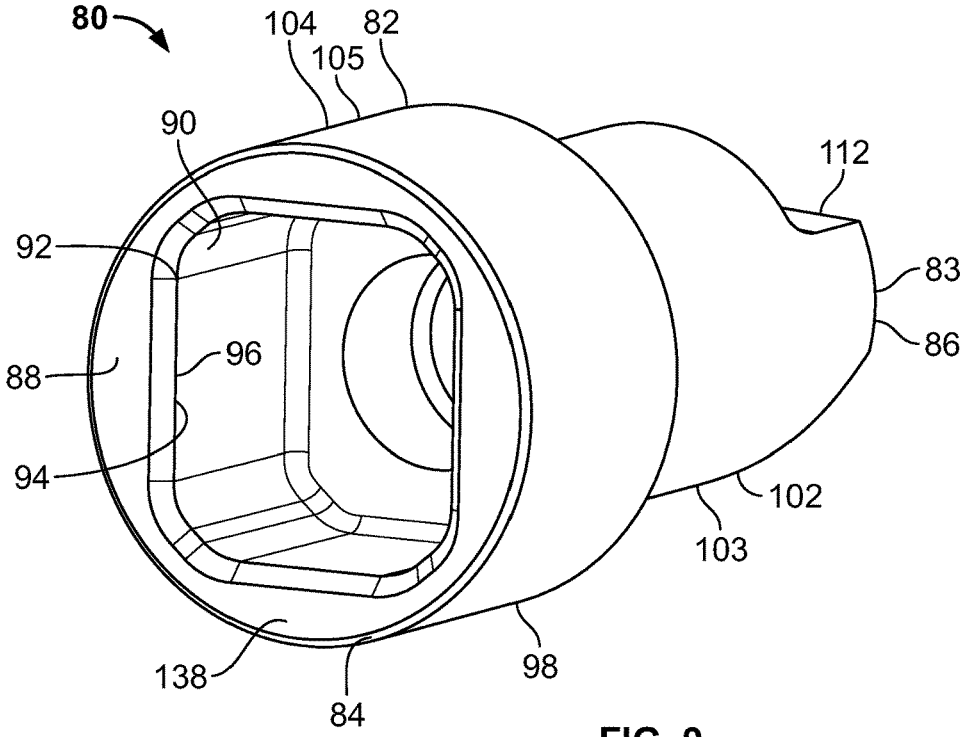
FIG. 9 is a perspective view of the latch pin used in the assembly, constructed in accordance with principles of this disclosure.
Figure 10:
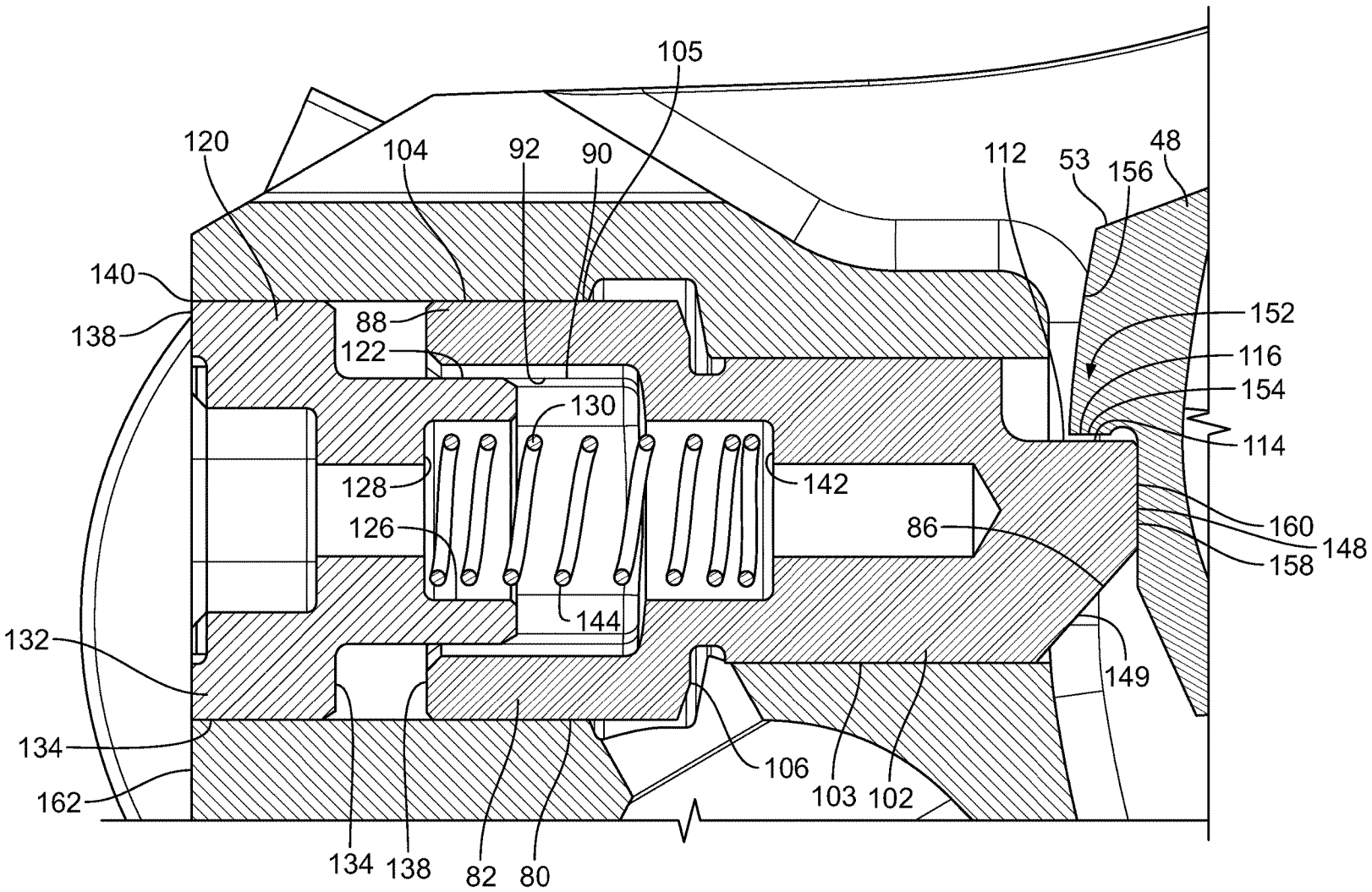
FIG. 10 is an enlarged, cross-sectional view showing the latch pin assembly in an engaged position in the rocker arm.

The latch pin assembly 40 in FIGS. 2, 4, and 6-10 includes a latch pin 80. The latch pin 80 includes a pin body 82 having a first end 83 and an opposite second end 84. At the first end 83 is an arm engaging head 86. At the second end 84 is a retainer engaging tail 88. As can be seen in FIGS. 9 and 10, the pin body 82 defines an internal open volume 90. The open volume 90 can have a non-circular cross section 92.

While a variety of aspects of the present teachings are contemplated, in the illustrated examples, the cross-section 92 of the body open volume 90 is polygon shaped. In particular, it is illustrated as being regular polygon-shaped. In this example, the regular polygon-shaped cross-section of the open volume 90 is rectangular. The rectangular cross-section may have somewhat rounded corners, as can be seen in FIG. 9. That is, by the term "rectangular" it does not require a perfect rectangle with sharp corners.

Still in reference to FIG. 9, the retainer engaging tail 88 can include an open mouth 94. The open mouth 94 can be in communication with the open volume 90 of the pin body 82. The mouth 94 can have a non-circular cross section 96. In the example shown, the cross-section 96 of the mouth 94 can have a same shape as the cross-section 92 of the open volume 90 of the pin body 82. As such, the cross-section 96 of the mouth 94 can be polygon shaped, for example regular polygon shaped. In the particular example shown, the cross-section 96 of the mouth 94 is rectangular, which can include rounded corners.

Still in reference to FIG. 9, it can be seen how in this example, the pin body 82 has a circular outer dimension 98. This circular outer dimension 98 fits within a cylindrical bore 100 in the outer arm 42.

In the particular one shown in the drawings, the pin body 82 has a first section 102 with a first outer diameter 103 and a second section 104 with a second outer diameter 105. The second outer diameter 105 can be greater than the first outer diameter 103. In the example shown, the first section 102 is adjacent to the arm engaging head 86, while the second section 104 includes and is part of the retainer engaging tail 88. Between the first section 102 and second section 104 of the pin body 88 can be a step 106.

In FIG. 7, the bore 100 within the outer arm 42 likewise can have a first section 107 with a first diameter 108 and second section 109 with second diameter 110. The second diameter 110 of the bore 100 can be greater than the first diameter 108. The first diameter 108 can be sized to receive the first section 102 of the pin body 82, but not the second section 104 of the pin body 82. The second section 109 of the bore 100 can be sized to hold and receive the second section 104 of the pin body 82. This can be seen in FIGS. 2, 4, and 10.

As can be seen in FIGS. 2, 4, 7, and 10, the arm engaging head 86 can include a shelf 112. The shelf 112 is the portion of the pin body 82 that can engage the inner arm 48. In this example, and as shown in FIG. 10, the shelf 112 can have a flat engagement surface 114. In FIG. 10, it can be seen how the flat engagement surface 114 of the shelf 112 can contact a flat engagement surface 116 of the inner arm 48. In particular, the flat engagement surface 114 of the shelf 112 can be in selective engagement against the connection member 53 of the inner arm 48.

In the example shown in FIG. 10, the arm engaging head 86 of the latch pin 80 includes an end face 148. The end face 148 in this example can be flat and engages against the inner arm 48 at the connection member 53. The end face 148, in the example shown, can be generally perpendicular to the flat engagement surface 114 of the shelf 112. The inner arm 48 can engage the latch pin 80 at both the end face 148 and the engagement surface 114 of the shelf 112. Between the end face 148 and the first section 102 of the pin body 82, there can be an angled face 149. In other words, in the depicted example (other examples possible), the arm engaging head 86 of the pin body 82 can be tapered from the first section 102 inwardly in a direction toward the end face 148 and at a side of the arm engaging head 86 opposite of the shelf 112. The angle between the end face 148 and angled face 149 can be about 210-230°. The angled face 149 is for possibly engaging against connection member 53 of the inner arm 48, when the latch pin 80 is in the disengaged position (FIG. 4) and the lifting portion 28 of the cam 22 has pushed the inner arm 48 down relative to the outer arm 42 and the latch pin 80—that is, if oil pressure is temporarily reduced when the latch pin 80 is in the disengaged position, the latch pin 80 may move via the force of spring 144 in a direction toward the engaged position (FIGS. 2 and 10); the slope on the connection member 53 on the inner arm 48 and on the angled face 149 helps to push the latch pin 80 back into the disengaged position (FIG. 4) in the outer arm 42. The slope and on the connection member 53 and the angled face 149 typically will be about the same angled slope.

In FIG. 10, it can be seen how the connection member 53 of the inner arm 48 can define a latch catch 152. The latch catch 152 can include a step 154 defined between a projecting region 156 and a recessed region 158. The flat engagement surface 116 on the inner arm 48 can be part of the step 154 as the inner arm 48 transitions from the projection region 156 to the recessed region 158. The flat engagement surface 116 on the step 154 can be oriented so that it faces and opposes the flat engagement surface 114 of the shelf 112, when the latch pin assembly 40 is in the engaged position (FIG. 10). The recessed region 158 can define a flat surface 160 that is angled relative to the flat engagement surface 116 at an angle of 85-95°, usually about 90°. This flat surface 160 can engage against the end face 148 of the latch pin 80.

It will be appreciated in light of the disclosure that because of the features of this latch pin assembly 40, the pin body 82 can stay in position so that the flat engagement surfaces 114, 116 can remain opposed and generally parallel to each other for good contact and engagement.

The latch pin assembly 40 further includes a retainer 120. The retainer 120 can have a male engagement portion 122, which can be received within the open volume 90 of the pin body 82 through the open mouth 94. The male engagement portion 122, in this example, can have a non-circular cross-section 124. In one example, the cross-section 124 of the male engagement portion 122 is polygon shaped, for example, regular polygon shaped. In the particular examples illustrated in FIG. 8, the male engagement portion 122 can have an octagon shaped cross-section. In FIG. 10, it can be seen how the male engagement portion 122 can fit within and is received within the open volume 90 of the pin body 82.

In the example depicted, the male engagement portion 122 can have an inner recess 126 therewithin. The recess 126 can operate as a spring seat 128. The spring seat 128 can hold a biasing mechanism 130, which is further described below.

Still in reference to FIG. 8, the retainer 120 can include an outer portion 132. The outer portion 132 can have an outer dimension 134 that is greater than an outer most dimension of the male engaging portion 122. Between the outer portion 132 and the male engagement portion 122, the retainer 120 can have a step 136. When the retainer 120 is operably positioned with the male engaging portion 122 within the open volume of the latch pin 80, the step 136 can act as a stop and is engaged against an end face 138 of the retainer engaging tail 88, when the latch pin assembly 40 is in a disengaged position. When the latch pin assembly 40 is in an engaged position, the end face 138 of the retainer engaging tail 88 can be spaced from the step 136.

The outer portion 132 of the retainer 120 can be sized to be received within the second section 109 of the bore 100 in the outer arm 42 (FIG. 7). In this example, after the latch pin assembly 40 is assembled within the rocker arm 30, the outer portion 132 can be non-removably secured to the outer arm 42. This securing can be done by a mechanical or chemical bond. In this example, a welded joint 140 (FIGS. 5 and 10) can non-removably secures the retainer 120 to the rocker arm 30. For example, the welded joint 140 is formed by welding the outer portion to the outer arm 42.

As can be seen in FIG. 5, the outer arm 42 can include an outer arm face 162 and need not include any additional grooves, etc., for holding the latch pin assembly 40. That is, the outer arm 42 can be groove-free at the location where the latch pin assembly 40 is secured, i.e. it is groove-free at the outer arm face 162.

The latch pin assembly 40 can further include biasing mechanism 130, mentioned above. The biasing mechanism 130 can be oriented in the open volume 90 of the pin body 82 and can be between and against the latch pin 80 and the retainer 120. In particular, the biasing mechanism 130 can be between and against the spring seat 128 of the retainer 120 and an inner end surface 142 (FIG. 10) in the open volume 40 of the pin body 82. In this example, the inner end surface 142 can be in the first section 102 of the pin body 82. The biasing mechanism 130 can be used to move the latch pin 80 within the bore 100 and relative to the retainer 120 between the engaged position (FIGS. 2 and 10) and the disengaged position (FIG. 4). In the example shown, the biasing mechanism can be a coiled spring 144.

In the assembled rocker arm 30, the latch pin 80 alternates between the engaged position and disengaged position. To deactivate the rocker arm 30, oil pressure sufficient to counteract the biasing force of the spring 144 may be applied, for example through port 146 (FIG. 4) which can be configured to permit oil pressure to be applied against the step 106 of the latch pin 80. When the oil pressure is applied, the latch pin 80 can be pushed toward the first end 36 of the rocker arm 30, until the end face 138 of the latch pin 80 engages against the step 136 of the retainer 120, thereby withdrawing the latch pin 80 including the arm engaging head 86 from engagement with the connection member 53 of the inner arm 48. This can be shown to allow the inner arm 48 to rotate about the pivot axle 54, which results in the bearing axle 60 to moving linearly within the axle slots 62 responsive to the lift lobes 26 of the cam 22. To activate the rocker arm 30, the oil pressure on the latch pin 80 can be released, which can allow the spring 144 to push the latch pin 80 by engagement against the inner end surface 142, until the flat engagement surface 114 of the shelf 112 is against the inner arm 48. This can secure the outer arm 42 and inner arm 48 together, causing the outer arm 42 and inner arm 48 to move together in response to the cam 22 and periodically push the valve stem 32.

It should be appreciated in light of the disclosure that, in this example, the latch pin assembly 40 includes no more than three parts, those parts being the latch pin 80, the retainer 120, and the biasing mechanism 130. In this example, the latch pin assembly 40 needs no more than these three parts, and it can be said that the latch pin assembly 40, in this example, consists essentially of no more than three parts being the latch pin 80, retainer 120, and biasing mechanism 130. This results can be shown to be a cost effective solution to the problem and quicker and easier manufacturing steps.

D. Methods

Methods of assembling the latch pin assembly 40 to the rocker arm 30 can be applied. First, the rocker arm 30 having outer arm 42, inner arm 48, pivot axle 54 securing the outer arm 42 and inner arm 48 is provided. The outer arm 48 will have the bore 100. The bore 100 provides access from outside of the rocker arm 30 through the outer arm 42 to the inner arm 48.

The method includes inserting the latching pin 80 into the bore 100 until the arm engaging head is in engagement with the inner arm 48. The pin body 82 has the open volume 90 with the non-circular cross-section 92.

of the method further includes inserting the biasing mechanism 130 into the open volume 90. The retainer 120 can be inserted into the open volume 90 of the pin body 82.

The retainer 120 can include the male engagement member 122 with a non-circular cross-section.

The retainer 120 can be non-removably secured to the outer arm 42. For example, the step of non-removably securing the retainer 120 to the outer arm 42 can include welding the retainer 120 to the outer arm 42.

Inserting the retainer 120 into the open volume 90 of the pin body 82 can include inserting the retainer 120 through the bore 100 and into the open volume 90 of the pin body 82 until the end face 138 of the retainer 120 is in line or flush with a face 162 of the outer arm.

Figure 11A:
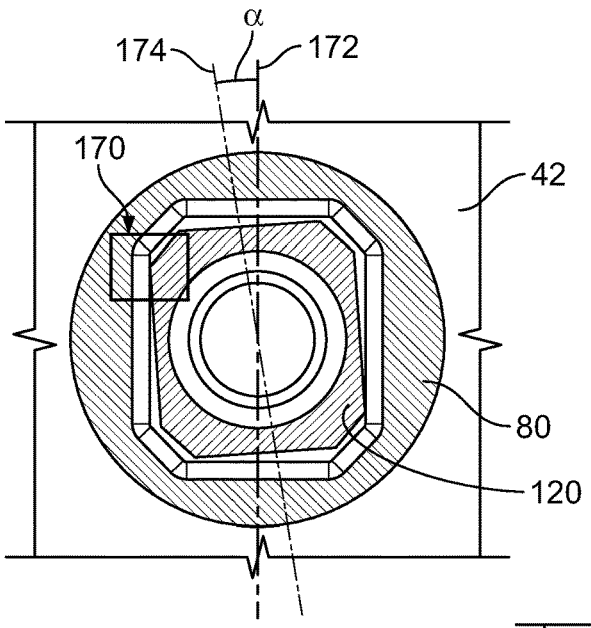
FIGS. 11A and 11B are schematic end views of the latch pin and retainer being mounted in the outer arm and depicting a process of balancing the latch pin rotation within a bore in the outer arm.

The latch pin assembly 40 allows the latch pin 80 to be balanced within the bore 100, which can be shown to further reduce the rotation of the pin 80 within the bore 100. This process can also be shown to eliminate or reduce the influence over latching pin rotation due to variations in the shelf 112 and inner arm latch catch 152 from nominal conditions. For example, and in reference now to FIG. 11, there can be a step of rotating the retainer 120 from a center position within the open volume 90 of the pin body 82 both clockwise and counterclockwise until there is stopped engagement between the retainer 120 and the pin body 82. The method can also include recording the degrees of rotation from the center in both the clockwise and counterclockwise positions. For example, in FIG. 11A, there is rotation of the retainer 120 in the counter clockwise position until the male engagement portion 122 contacts the inner wall of the cross-section 92 of the open volume 90 of the pin body 82 at 170. The number of degrees off center until this engagement occurs is recorded. This number of degrees is shown in FIG. 11A at angle $\alpha$ as the difference between the axis 172 of the latch pin 80 at center and the axis 174 of the male engagement portion 122 after it makes contact with the inner wall at 170.

Figure 11B:
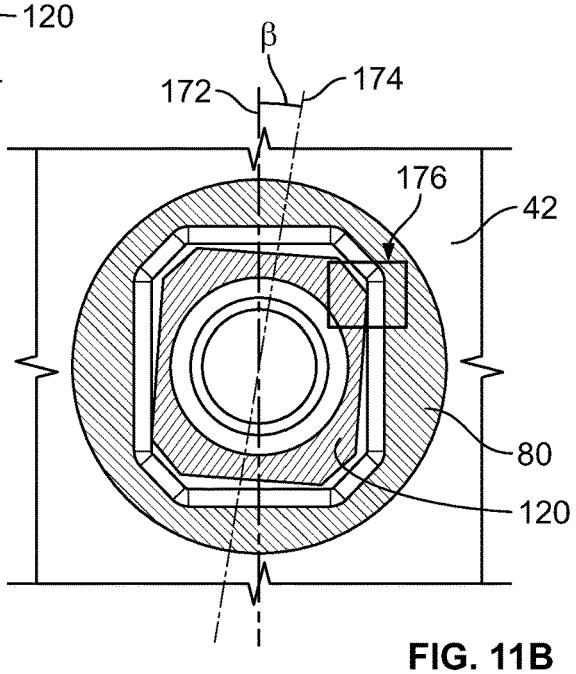
Figure 12:
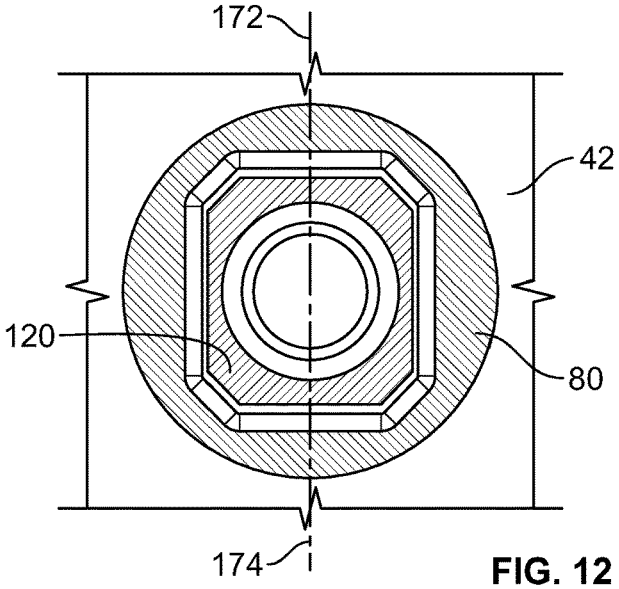
FIG. 12 is a schematic end view similar to the views of FIGS. 11A and 11B and showing a final position of the retainer and latch pin after non-removably securing the retainer to the outer arm.

Similarly, the retainer 120 can be rotated in the clockwise position (FIG. 11B) until there is engagement at point 176 between the male engagement portion 122 and the inner wall of the cross-section 92 of the open volume 90 of the pin body 82. This amount of rotation off center is recorded in degrees. This number of degrees is shown in FIG. 11B at angle $\beta$ as the difference between the axis 172 of the latch pin 80 at center and the axis 174 of the male engagement portion 122 after it makes contact with the inner wall at 176. Based on the recorded degrees of rotation from the center in both the clockwise and counterclockwise positions, a new center position can be calculated. The retainer 120 is then fixed on the new center position for non-removably securing the retainer 120 to the outer arm 42. FIG. 12 shows the new center position, and the axis 172 of the latch pin 80 and axis 174 of the retainer 120 are in alignment with each other.

The methods of balancing the latch pin rotation in the bore 100 can be preceded by inserting the latch pin 80 in the bore 100 of the outer arm 42 and then locking the latch pin 80 in place by engagement of the shelf 112 with the catch 152 of the inner arm 48.

In one example of balancing, the retainer 120 can be rotated counterclockwise until there was a stop due to engagement 170 between the retainer 120 and the inner wall of the open volume 90 of the pin body 82. This was recorded as angle $\alpha$ of 6°. Next, the retainer 120 was placed back at the center and rotated clockwise until there was engagement 176 between the retainer 120 and the inner wall of the open volume 90 of the pin body 82. This was recorded as angle $\beta$ of 2°. Next, these degrees off center were added together and divided by 2, e.g. (6°+2°)/2=4°. The new center is then calculated by moving the retainer 120 2° counterclockwise from the original center to a position of −2° (or alternatively, +4° from the extreme counterclockwise position of −6° the location at engagement position 170 to anew position of −2°) so the result would be rotation of 4° clockwise or counterclockwise on either side of the new center due to the tolerances. It is at this new center where the retainer 120 is fixed and permanently secured to the outer arm, for example, by welding.

The invention claimed is:

1. A latch pin for a rocker arm in a valve actuation arrangement; the latch pin comprising:

(a) a latch pin having a pin body with first and second opposite ends; an arm engaging head at the first end; and a retainer engaging tail at the second end;

(i) the pin body defining an open volume;

(ii) the retainer engaging tail having an open mouth in communication with the open volume of the pin body;

(A) the open volume has a non-circular cross-section, the non-circular cross-section including at least first and second opposite sides with rounded corners;

(b) a retainer having a male engagement portion;

(i) the male engagement portion being received within the open volume of the pin body through the open mouth;

(A) the male engagement portion having a non-circular cross-section; and (c) a spring oriented in the open volume of the pin body and being between and against the latch pin and the retainer.

2. The latch pin of claim 1 wherein:

(a) the mouth has a non-circular cross-section in a same shape as the pin body open volume cross-section.

3. The latch pin of claim 1 wherein:

(a) the pin body has a circular outer dimension.

4. The latch pin of claim 3 wherein:

(a) the pin body has a first section with a first outer diameter and a second section with a second outer diameter;

(i) the second outer diameter being greater than the first outer diameter;

(ii) the first section being adjacent to the arm engaging head; and (iii) the second section including the retainer engaging tail.

5. The latch pin of claim 1 wherein:

(a) the arm engaging head includes a shelf having a flat engagement surface.

6. The latch pin of claim 1 wherein the open volume includes at least third and fourth opposite sides between the first and second opposite sides.

7. The latch pin of claim 6 wherein:

(a) the open volume has a polygon-shaped cross-section.

8. The latch pin of claim 6 wherein the open volume of the pin body and the male engagement portion of the retainer are shaped to limit relative rotation therebetween.

9. The latch pin of claim 1 wherein:

(a) the male engagement portion has a polygon-shaped cross-section.

10. The latch pin of claim 9 wherein:

(a) the male engagement portion has an octagon-shaped cross-section.

11. The latch pin of claim 1 wherein:

(a) the retainer includes an outer portion having an outer dimension greater than an outermost dimension of the male engagement portion;

(i) a step being between the outer portion and the male engagement portion;

(ii) the step being in engagement against an end face of the retainer engaging tail.

12. The latch pin of claim 1 wherein:

(a) the male engagement portion includes a spring seat to hold the spring.

13. The latch pin of claim 1 wherein the arm engaging head is flat.

14. A rocker arm for engaging a cam in a valve actuation arrangement;

the rocker arm comprising:

(a) an outer arm having spaced first and second outer side arms;

(b) an inner arm having first and second inner side arms between the first and second outer side arms;

(c) a pivot axle securing the outer arm and the inner arm;

(d) a cam contacting member configured to transfer motion from a cam to the rocker arm; and (e) a latch pin assembly held by the outer arm and being moveable between an engaged position and a disengaged position; the engaged position securing the outer arm and inner arm together causing the outer arm and inner arm to move together in response to the cam, and the disengaged position permitting the inner arm to pivot relative to the outer arm about the pivot axle in response to the cam; the latch pin assembly including, (i) a latch pin having a pin body with first and second opposite ends; a head at the first end selectively engaging the inner arm; and a tail at the second end; the pin body defining an open volume; the retainer engaging tail having an open mouth in communication with the open volume of the pin body; the open volume having a non-circular cross-section, the non-circular cross-section including at least first and second opposite sides with rounded corners;

(ii) a retainer having a male engagement portion and an outer portion; the male engagement portion being within the open volume of the pin body through the open mouth; the male engagement portion having a non-circular cross-section; the outer portion being non-removably secured to the outer arm; and (iii) a spring oriented in the open volume of the pin body and being between and against the latch pin and the retainer.

15. The rocker arm of claim 14 wherein:

(a) the inner arm includes a connection member joining the first and second inner side arms; and (b) the head of the latch pin includes a shelf with a flat surface; the flat surface being in selective engagement against the connection member of the inner arm.

16. The rocker arm of claim 14 wherein:

(a) a welded joint non-removably secures the outer portion of the retainer to the outer arm.

17. The rocker arm of claim 14 wherein:

(a) the outer arm includes a cylindrical bore with at least first and second diameter regions; the latch pin assembly being held within the cylindrical bore.

18. The rocker arm of claim 14 wherein:

(a) the cam contacting member comprises a roller bearing between the first and second inner side arms.

19. The rocker arm of claim 14 wherein the head is flat.

20. The rocker arm of claim 14 wherein:

(a) the latch pin body includes a first section having a first outer diameter adjacent to the head, and a second section having a second outer diameter defining the tail;

(i) the first section being between the head and the second section;

(ii) the second outer diameter being greater than the first outer diameter;

(b) the outer arm includes a bore sized to hold the latch pin; and (c) the first section of the latch pin is contained within the bore and does not extend out of the bore when the latch pin assembly is in both the engaged and disengaged positions.

21. A method of assembling a latch pin assembly to a rocker arm; the method comprising:

(a) providing a rocker arm having an outer arm and an inner arm; and a pivot axle securing the outer arm and the inner arm; the outer arm having a bore;

(b) inserting a latching pin having a pin body with a head and tail into the bore until the head is in engagement with the inner arm; the pin body having an open volume with a non-circular cross-section, the non-circular cross-section including at least first and second opposite sides with rounded corners;

(c) inserting a spring in the open volume;

(d) inserting a retainer into the open volume of the pin body; the retainer having a male engagement portion with a non-circular cross-section; and (e) nonremovably securing the retainer to the outer arm.

22. The method of claim 21 wherein:

(a) the step of inserting the retainer into the open volume of the pin body includes inserting the retainer until a face of the retainer is in line with a face of the outer arm.

23. The method of claim 21 wherein:

(a) before the step of nonremovably securing the retainer to the outer arm, rotating the retainer from a center position within the open volume of the pin body both clockwise and counter clockwise until there is stopped engagement between the retainer and the pin body;

(b) recording the degrees of rotation from the center in both the clockwise and counter clockwise positions;

(c) based on the recorded degrees of rotation from the center in both the clockwise and counter clockwise positions, calculating a new center position; and (d) fixing the retainer on the new center position for nonremovably securing the retainer to the outer arm.

24. The method of claim 21 wherein:

(a) the nonremovably securing the retainer to the outer arm includes welding the retainer to the outer arm.

25. The method of claim 21 wherein the step of inserting the latching pin includes inserting the latching pin until the head is flat against the inner arm.

26. A rocker arm for engaging a cam in a valve actuation arrangement;

the rocker arm comprising:

(a) an outer arm having spaced first and second outer side arms; the outer arm including a pin-holding bore;

(b) an inner arm having first and second inner side arms between the first and second outer side arms;

(c) a pivot axle securing the outer arm and the inner arm;

(d) a cam contacting member configured to transfer motion from a cam to the rocker arm; and (e) a latch pin assembly held by the outer arm and being moveable between an engaged position and a disengaged position; the engaged position securing the outer arm and inner arm together causing the outer arm and inner arm to move together in response to the cam, and the disengaged position permitting the inner arm to pivot relative to the outer arm about the pivot axle in response to the cam; the latch pin assembly including, (i) a latch pin having a pin body with first and second opposite ends; a head defining a shelf at the first end selectively engaging the inner arm; a tail at the second end; the pin body defining an open volume; the retainer engaging tail having an open mouth in communication with the open volume of the pin body; the pin body including a first section having a first outer diameter adjacent to the head, and a second section having a second outer diameter defining the tail;

(A) the first section being between the head and the second section;

(B) the second outer diameter being greater than the first outer diameter;

(C) the first section of the latch pin being contained within the pin-holding bore and not extending out of the pin-holding bore when the latch pin assembly is in both the engaged and disengaged positions;

(ii) a retainer having a male engagement portion and an outer portion; the male engagement portion being within the open volume of the pin body through the open mouth; the outer portion being non-removably secured to the outer arm; and (iii) a spring oriented in the open volume of the pin body and being between and against the latch pin and the retainer.

27. The rocker arm of claim 26 wherein the mouth has a non-circular cross-section.

28. The rocker arm of claim 26 wherein the head is flat.

29. The rocker arm of claim 26 wherein:

(a) the inner arm includes a connection member joining the first and second inner side arms; and (b) the head of the latch pin includes a shelf with a flat surface; the flat surface being in selective engagement against the connection member of the inner arm.

30. The rocker arm of claim 29 wherein the male engagement portion has a non-circular cross-section.

* * * * *